US007852975B2

(12) United States Patent
Mirzadeh et al.

(10) Patent No.: US 7,852,975 B2
(45) Date of Patent: Dec. 14, 2010

(54) PRODUCTION OF THORIUM-229 USING HELIUM NUCLEI

(75) Inventors: Saed Mirzadeh, Knoxville, TN (US); Marc Alan Garland, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 12/422,679

(22) Filed: Apr. 13, 2009

(65) Prior Publication Data

US 2009/0257543 A1 Oct. 15, 2009

Related U.S. Application Data

(62) Division of application No. 11/506,580, filed on Aug. 18, 2006, now abandoned, which is a division of application No. 10/938,044, filed on Sep. 10, 2004, now abandoned.

(60) Provisional application No. 60/503,149, filed on Sep. 15, 2003.

(51) Int. Cl.
*G21G 1/12* (2006.01)

(52) U.S. Cl. ..... 376/157; 376/156; 376/190

(58) Field of Classification Search ..... 376/157, 376/156, 170

See application file for complete search history.

(56) References Cited

U.S. PATENT DOCUMENTS

| | | | |
|---|---|---|---|
| 3,269,915 | A | 8/1966 | Ransohoff et al. |
| 3,459,634 | A | 8/1969 | Ruiz et al. |
| 4,622,201 | A | 11/1986 | Robertson et al. |
| 5,037,602 | A | 8/1991 | Dabiri et al. |
| 5,355,394 | A | 10/1994 | Van Geel et al. |
| 5,809,394 | A | 9/1998 | Bray et al. |
| 5,848,110 | A | 12/1998 | Maenchen et al. |
| 6,011,825 | A | 1/2000 | Welch et al. |
| 6,127,527 | A | 10/2000 | Geerlings |
| 6,358,040 | B1 | 3/2002 | Pfefferle et al. |

OTHER PUBLICATIONS

Boll et al., "Production of actinium-225 for alpha particle mediated radioimmunotherapy", Applied Radiation and Isotopes 62:667-679 (2005).

Apostolidis et al., "Cyclotron production of Ac-225 for targeted alpha therapy", Applied Radiation and Isotopes 62:383-387 (2005).

Vargas et al., "On the Determination of 223Ra and 224 Ra from their Daughter Products in Electrodeposited Sources of Radium", Appl. Radiat. Isot. 47(1):129-130 (1996).

Hancock et al, "Reply to Vargas and de Soto: On the Determination of 223Ra and 224 Ra from their Daughter Products . . . ", Appl. Radiat. Isot. 47(1):131-1320 (1996).

Mirzadeh, "Generator-produced Alpha-emitters", Appl. Radiat. Isot. 49(4):345-349 (1998).

Konecny et al., "Fission Energetics and Neutron Emission in 13-MeV Proton-Induced Fission of 226Ra", Phys. Rev. 173(4):1213-1226 (1968).

Jensen et al., "Fission of Ra226 by 11-Mev Protons", Phys. Rev. 109(3):942-946 (1958).

Kudo et al., "Fission fragment yields in the fission of 232Th by protons of energies 8 to 22 MeV", Phys. Rev. 25(6):3011-3023 (1982).

Caldwell et al., "Giant resonance for the actinide nuclei: Photoneutron and photofission cross sections for 235U, 236U, and 232Th", Phys Rev. 21(4):1215-1231 (1980).

Huizenga et al., Helium-Ion-Induced Fission of Bi, Pb, Tl, and Au, Phys. Rev., 126(1):210-219 (1962).

Chase et al., Principles of Radioisotope Methodology, Burgess Publ. Co., Minneapolis, MN, 3d ed., 146-162 (1968).

DE-SC05-01OR22872, Notice of Program Interest, Development of Programs for Ac-225/B-213 Generators for uses in Medicine, Department of Energy, 2001.

GE Nuclear Energy, Nuclides and Isotopes, 14th Edition, 1989.

Gindler et ai., Fission Fragment Angular Distributions in Charged-Particle-Induced Fission of Ra-226, Phys. Rev., 136, 58 (1964), pp. 81333-81344.

*Primary Examiner*—Rick Palabrica
(74) *Attorney, Agent, or Firm*—Novak Druce + Quigg LLP; Gregory A. Nelson; Gregory M. Lefkowitz

(57) ABSTRACT

A method for producing $^{229}$Th includes the steps of providing $^{226}$Ra as a target material, and bombarding the target material with alpha particles, helium-3, or neutrons to form $^{229}$Th. When neutrons are used, the neutrons preferably include an epithermal neutron flux of at least $1\times10^{13}$ n $s^{-1}\cdot cm^{-2}$. $^{228}$Ra can also be bombarded with thermal and/or energetic neutrons to result in a neutron capture reaction to form $^{229}$Th. Using $^{230}$Th as a target material, $^{229}$Th can be formed using neutron, gamma ray, proton or deuteron bombardment.

14 Claims, 1 Drawing Sheet

| Nuclide | Thermal Cross Section (b) | Resonance Integral (b) |
|---|---|---|
| $^{226}$Ra | 13 | 290 |
| $^{227}$Ra | ? | ? |
| $^{228}$Ra | 36 | ? |
| $^{226}$Ac | 100 | 1700 |
| $^{227}$Ac | 890 | 1700 |
| $^{228}$Ac | ? | ? |
| $^{227}$Th | 1500 | 1400 |
| $^{228}$Th | 120 | 1200 |
| $^{229}$Th | 63 | 1200 |

PRODUCTION OF THORIUM-229 USING HELIUM NUCLEI

CROSS-REFERENCE TO RELATED APPLICATIONS

This application is a divisional of U.S. application Ser. No. 11/506,580, filed Aug. 18, 2006, which is a divisional of U.S. patent application Ser. No. 10/938,044, filed Sep. 10, 2004, which claims the benefit of U.S. Provisional Application No. 60/503,149, entitled Process For Production of Thorium-229, filed Sep. 15, 2003, all of which are incorporated herein in their entirety by reference.

STATEMENT REGARDING FEDERALLY SPONSORED RESEARCH OR DEVELOPMENT

The United States Government has rights in this invention pursuant to Contract No. DE-AC05-00OR22725 between the United States Department of Energy and UT-Battelle, LLC.

FIELD OF THE INVENTION

The invention relates to methods for producing thorium-229.

BACKGROUND OF THE INVENTION

The goal in the treatment of cancerous tumors and micrometastases has long been to kill the cancerous cells without killing healthy cells. Today, in the development of new short-range, site-specific therapies, there is increasing interest in using radioisotopes which decay with the emission of alpha particles. Indeed, recent clinical trials have shown the effectiveness of the alpha-emitter bismuth-213 in killing cancer cells in patients with acute myeloid leukemia. In addition, lung tumors in mice have been effectively treated for the first time by using an antibody radiolabeled with bismuth-213, targeting the lung vascular endothelial cells.

Alpha-particles are of interest in site-specific therapy because of their short range. Bismuth-213 emits an 8 MeV alpha particle which penetrates only 6 to 10 cell layers nearby, killing the cells in its short path (~80 μm), including cancer cells. In addition to bismuth-213, there are only eight other known alpha-emitters with potential for this type of application, namely, astatine-211, bismuth-212, lead-212, radium-223, radium-224, radium-225, actinium-225, and fermium-255.

There are a number of factors that need to be considered in using any radioisotope in humans, especially those radioisotopes emitting alpha particles. These factors include availability, cost, nuclear characteristics, chemistry, and in vitro and in vivo stability of the biomolecules labeled with alpha-emitters. The first two alpha-emitters to be used in human trials are bismuth-213 and astatine-211; the other seven radioisotopes mentioned above are under more preliminary investigations. Bismuth-213 is currently being used in human trials at Memorial Sloan-Kettering Cancer Center (New York) and is generated in-house from the decay of actinium-225. This radioisotope is produced from the decay of radium-225, which is the daughter of thorium-229, which, in turn is the alpha decay daughter of uranium-233.

Currently, uranium-233 is the only viable source for high purity thorium-229. However, the anticipated growth in demand for actinium-225 may soon exceed the levels of thorium-229 present in the aged uranium-233 stockpile (in fact, there have been occasions that supply has not been able to keep up with the current demand). It is estimated that only ~45 g or ~9 curies of thorium-229 ($^{229}$Th specific activity is 0.2 mCi/mg) can be extracted from entire uranium-233 stockpile at the Oak Ridge National Laboratory (hereinafter "ORNL"). The uranium-233 stockpile at ORNL is about 50% of the high quality uranium-233 available in the world which provides reasonably low quantities of both Th-228 and Th-232. This stockpile is only about eighty times the current thorium stock. Large quantities of Th-228 or Th-232 can make the use of a uranium-233 stockpile impractical. Considering the rather low annual production rate of thorium-229 from uranium-233 (0.92 mCi/kg) and the increasing difficulties associated with uranium-233 safeguards, large-scale routine processing of uranium-233 is, at a minimum, problematic.

A number of approaches have been identified as alternative routes for the production of $^{229}$Th($t_{1/2}$=7340 y), or for direct production of $^{225}$Ra($t_{1/2}$=15 d), and $^{225}$Ac ($t_{1/2}$=10 d). These approaches include a) production of $^{229}$Th in a nuclear reactor by thermal neutron transmutation of $^{226}$Ra targets, b) direct production of $^{225}$Ac from proton and deuteron irradiation of $^{226}$Ra targets via the [p,2n] and [d,3n] reactions, respectively, at accelerators, and c) indirect production of $^{225}$Ac from the decay of $^{225}$Ra which in turn is produced by high energy γ-ray irradiation of a $^{226}$Ra target, [γ,n] reactions. The alternate route (a) noted above produces a low yield of $^{229}$Th.

SUMMARY OF THE INVENTION

A method for producing $^{229}$Th includes the steps of providing $^{226}$Ra as a target material, and bombarding the target material with alpha particles, helium-3, or neutrons to form $^{229}$Th. When the energetic particles comprise neutrons, the neutrons preferably include an epithermal neutron flux of at least $1\times10^{13}$n $s^{-1}\cdot cm^{-2}$. When alpha particles are used an energy of the alpha particles can be between 15 MeV and 25 MeV, such as about 20 MeV, and when helium-3 particles are used an energy of the helium-3 particles can be 8 MeV to 20 MeV, such as about 16 MeV.

A method for producing $^{229}$Th includes the steps of providing $^{228}$Ra as a target material, and bombarding the target material with neutrons to produce a neutron capture reaction of the $^{228}$Ra to form $^{229}$Th. The neutrons can be thermal and/or epithermal neutrons.

In another embodiment of the invention, a method for producing $^{229}$Th includes the steps of providing $^{230}$Th as a target material, and bombarding the target material with energetic particles to form $^{229}$Th. The energetic particles can comprise neutrons sufficient to result in a $^{230}$Th[n,2n]$^{229}$Th reaction to form $^{229}$Th. The energetic particles can comprise gamma rays having energies sufficient to result in $^{230}$Th[γ,n]$^{229}$Th reaction to form $^{229}$Th, such as having an energy of from 8 MeV to about 12 MeV. The energetic particles can comprise protons or deuterons having energies sufficient to result in $^{229}$Pa, the $^{229}$Pa decaying or transmuting into $^{229}$Th. When protons are used, the energy of the protons can be from 8 MeV to about 16 MeV. When deuterons are used, the energy of the deuterons can be from 16 MeV to about 28 MeV.

BRIEF DESCRIPTION OF THE DRAWINGS

There are shown in the drawing embodiments which are presently preferred, it being understood, however, that the invention can be embodied in other forms without departing from the spirit or essential attributes thereof.

DETAILED DESCRIPTION OF THE INVENTION

Figure 1:
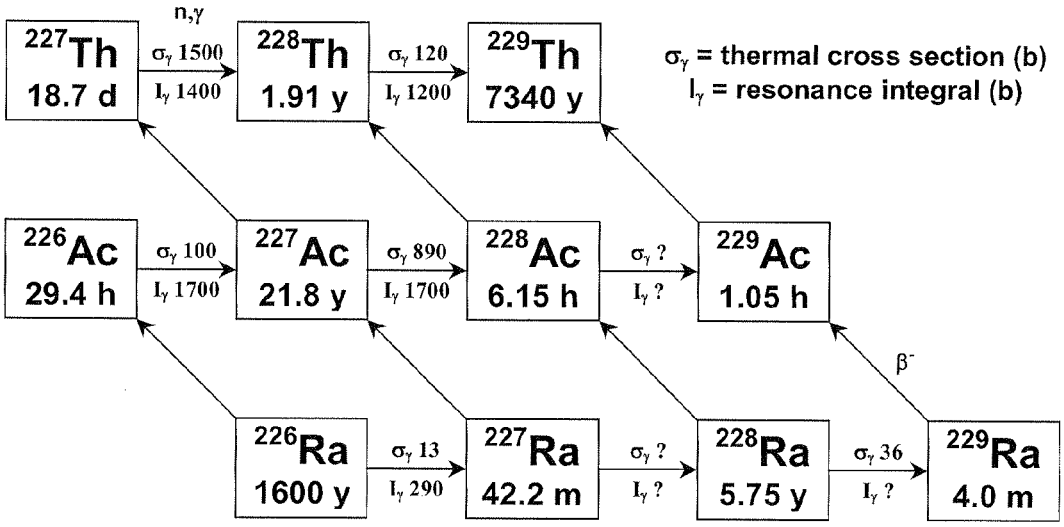
FIG. 1 shows the neutron capture cross sections for the irradiation of radium-226 with an accompanying table below summarizing the data.

The invention provides methods for the production of thorium-229. The methods have good yields and generally lower contamination levels as compared to known methods for production of thorium-229 other than by decay of U-233.

In a first embodiment, thorium-229 is produced via alpha particle bombardment of a radium-226 target, such as using a cyclotron. Radium-226 is a by-product of uranium processing and significant quantities of $^{226}$Ra can be readily made available if a use for this isotope is identified. The amount of $^{226}$Ra in naturally occurring uranium is about 0.33 g per ton of uranium.

No excitation function for the 226Ra[α,n]$^{229}$Th reaction is currently known. However, from the excitation functions known for $^{209}$Bi[α,xn] reactions, a threshold energy of about 8 MeV can be expected, and a maximum cross section of ~2 barns at ~15 MeV. From systematics, the optimum incident energy of alpha particles for this reaction is about 20 MeV, and the maximum cross section for [α,n] is expected to be at least tenfold larger than that of the [p,n] reaction. The above assumptions translate to a production rate of ~1 μCi of $^{229}$Th per day at a 20 μA current of alpha particles with incident energy of ~20 MeV. By preferably controlling the incident α-particle energy just below the threshold of the [α,2n] reaction which is about 20 MeV, the production of unwanted $^{228}$Th can be minimized. For example, the energy of the alpha particles can be 15 to about 20 MeV, such as about 16 MeV.

The excitation function is preferably obtained to permit fine adjustment of the incident alpha particle energy such that the $^{229}$Th yield is maximized and $^{228}$Th contamination level is minimized. Very thin targets of $^{226}$Ra (1-2 μg/cm$^2$ by electrodeposition) can be used for excitation function measurements by a stacked foil technique. Preparation of very thin targets of $^{226}$Ra(1-2 μg/cm$^2$) by the electrodeposition method is known. Carrier-free $^{226}$Ra can be electroplated on Pt foil from 0.1 M $HNO_3$ under 8 volt of direct current. Yields of better than 80% have been obtained within 2 hours. Modification of this procedure could be used for preparation of thin targets of $^{226}$Ra using high purity Al foils having a thickness of about 0.1 mm. Each Ra deposited foil can then be covered with another Al foil and sealed by epoxy. The Al foils serve as energy degraders. For the excitation function measurements, the irradiation time could be limited to 10-60 minutes at a current of ~1 μA. The incident alpha particle energy will be about 20 MeV. Under these conditions, the level of activity in target foils will range from 0.1-1 pCi of $^{229}$Th per foil. After irradiation, the target will be allowed to cool for several days, then will be analyzed by gamma-ray spectroscopy.

Thorium-229 emits two predominant gamma rays at 193 and 213 keV with intensities of 4.4 and 3.0%, respectively. At equilibrium with its daughter products, however, more intense gamma rays from 4.8-min $^{218}$Fr at 218 keV (11.6%) and from 46.5-min $^{213}$Bi at 440 keV (26.1%) can be used for quantitation of $^{229}$Th. Accordingly, about 100 days should be allowed for 99.9% equilibrium. Th-228 can be quantitated by measuring the activity of $^{212}$Pb and $^{212}$Bi at 238 keV (43.9%) and 583 keV (31.1%), respectively. Th-228 reaches equilibrium within two weeks.

It is anticipated that both $^{226}$Ra and $^{229}$Th undergo fission during alpha bombardment or indirectly by secondary neutrons. The expected fission cross sections are rather small and in the millibarn (mb) range.

Helium-3 ($^3$He) bombardment can be used instead of alpha ($^4$He or α) particle bombardment to produce thorium-229 from radium-226. The reaction in this case would be $^{226}$Ra [$^3$He,γ]$^{229}$Th, with a threshold of about 8 MeV, but the maximum of the cross-section is expected to be about ten fold smaller than α-induced reaction, and thus about a ten fold lower yield. As in the case of alpha particle bombardment, excitation functions for this and competing reactions are not currently known.

In another embodiment of the invention, thorium-229 is produced via multiple-neutron capture by a radium-226 target in the epithermal region. A known approach for the production of $^{229}$Th is by thermal neutron irradiation of a radium-226 target in a reactor. This approach consists of a number of neutron captures and beta decays. As it implies, the thermal cross section is the probability of interaction of a nuclide with thermal neutrons while the resonance integral is the probability of interaction of the same nuclide with higher energy (epithermal) neutrons.

FIG. 1 shows neutron capture cross sections for the irradiation of radium-226 with the accompanying table below summarizing the data. In all the pathways shown leading to $^{229}$Th starting from a $^{226}$Ra target, the resonance integrals are far greater (in some cases an order of magnitude greater) than the thermal cross sections. For example, neutron capture by $^{226}$Ra has a thermal cross section of 13 b while the resonance integral is 290 b, more than an order of magnitude greater.

Thus, production of $^{229}$Th from neutron irradiation of a $^{226}$Ra target is much more efficient with higher energy neutrons as compared to irradiation with thermal neutrons. It is estimated that the contribution of epithermal neutrons to the total yield of $^{229}$Th is 99.2% in the case where a $^{226}$Ra target is irradiated in the core of a high flux isotope reactor (i.e., production due to thermal neutrons is only 0.8% of the total). Accordingly, much more $^{229}$Th can be produced by epithermal neutrons than using conventional thermal neutrons.

The most common sources of epithermal neutrons are research nuclear reactors. For example, in the flux trap region of the High Flux Isotope Reactor (HFIR) at ORNL, the epithermal neutron flux per unit lethargy is greater than $1\times10^{13}$n $s^{-1}\cdot cm^{-2}$ (generally ranging from $2\times10^{13}$ to $8\times10^{13}$ n $s^{-1}\cdot cm^{-2}$). Note that lower neutron fluxes will generally be of little use for this approach, because a 10 fold lower neutron flux results in ~1000-fold reduction in the $^{229}$Th yield. Alternatively, epithermal neutrons can be produced by slowing down fast neutrons available from charged particle accelerators where the fast neutrons are generated through a number of nuclear reactions such as fusion, fission, pick-up, spallation reactions, and others.

The significance of the contribution of epithermal neutrons to the total reaction rate, which is disclosed herein, can also be extended to the production of thorium-228 (and its daughters radium-224, lead-212, bismuth-212, and other daughter isotopes in this decay chain) and actinium-227 (and its daughters radium-223, and other daughter isotopes in this decay chain), two other radionuclides which may also prove useful for medical applications. It is noted that radium-226 is the target for the production of thorium-228 and actinium-227.

In another embodiment, thorium-229 can be produced via a neutron capture reaction of radium-228. Radium-228 with a half-life of 5.75 y, is the first alpha decay product of naturally occurring thorium-232, and can be made available through the chemical processing of natural thorium. The amount of $^{228}$Ra in 30-y old thorium is about 0.4 mg per ton of thorium.

The reported cross section for neutron capture of radium-228, $^{228}$Ra[n,γ]$^{229}$Ra is about 36 barns for thermal neutrons available from nuclear reactors. The cross section for epithermal neutrons is not currently known. The product of $^{228}$Ra neutron capture, $^{229}$Ra, has a half-life of only 4 min and decays with 100% $\beta^-$ to 62.7-min $^{229}$Ac, which in turn decays with 100% $\beta^-$ to $^{229}$Th. At a thermal neutron flux of $1\times10^{15}$ n/s·cm$^2$, the yield of $^{229}$Th from $^{228}$Ra[n,γ]$^{229}$Ra(β$^-$, $t_{1/2}$=4 min)$^{229}$Ac(β$^-$,$t_{1/2}$=1 hour)$^{229}$Th reaction is about 27 mCi per gram of $^{228}$Ra for one-year irradiation. The main advantage of this reaction will be higher yield of $^{229}$Th relative to other reactions, and significantly lower contamination with $^{228}$Th, and almost no contamination from 227Ac. The main disadvantage of this reaction is the relatively short half-life of the target material and its availability.

In another embodiment, thorium-229 is produced via neutron bombardment of a thorium-230 target. Thorium-230 with a half-life of 7.5×10$^4$ y, is a part of the uranium-238 decay chain, and depending on the geological location the amount of $^{230}$Th in uranium mines is about 16 g per ton of uranium.

The $^{230}$Th[n,2n]$^{229}$Th reaction has a threshold energy of 6.8 MeV and a cross section of 1.34 barns at 14 MeV. These assumptions translate to a production rate of ~2.5 nCi of $^{229}$Th per day per gram of $^{230}$Th at neutron flux of 10$^{11}$ n s$^{-1}$·cm$^{-2}$ with an energy of 14 MeV. The 14 MeV neutrons can be produced in a cyclotron through a number of nuclear irradiations, the most common being the irradiation of a Be target with deuterons having an energy of 30 MeV, generating a neutron flux of ~3×10$^{10}$ n·s$^{-1}$·μA$^{-1}$ at 0-20° solid angle. For a 10 μA deuteron beam, the total neutron flux in the forward direction would be ~3×10$^{11}$, distributed over an area ~2 cm$^2$. By controlling the incident deuteron energy below ~35 MeV, production of higher energy neutrons (>20 MeV) will be substantially minimized, and hence the production of unwanted $^{228}$Th which is produced via $^{230}$Th[n,3n]$^{228}$Th can be substantially reduced. It is noted that the threshold for the $^{230}$Th[n,3n]$^{228}$Th reaction is about 12 MeV. As noted above, high energy neutrons can be obtained from reactors such as High Flux Isotope Reactors. Alternatively, 14 MeV neutrons can be readily obtained from D-T fusion reactions. Also, high energy neutrons can be produced in charged particle accelerators via fission, fusion, pick-up, spallation, and other reactions.

Alternatively, high-energy neutrons available from a nuclear reactor can be used, where the flux of neutrons with energy >7 MeV is on the order of 5×10$^{13}$ n s$^{-1}$·cm$^{-2}$. The fission averaged cross section of $^{230}$Th[n,2n]$^{229}$Th reaction is 10.66 mb. The yield of $^{229}$Th from reactor irradiation of $^{230}$Th would be on the order of 10 nCi per gram of target per day or 3.7 μCi per gram per year of irradiation. The main disadvantage of the $^{230}$Th[n,2n]$^{229}$Th reaction would be the generation of fission products as the fission averaged cross section of $^{230}$Th is rather significant (163 mb).

In another embodiment, thorium-229 is produced via gamma ray bombardment of a thorium-230 target via the $^{230}$Th, [γ,n] reaction. No excitation function for the $^{230}$Th[γ, n]$^{229}$Th reaction is currently known. However, from the reported excitation functions for $^{232}$Th[γ,n] reactions, a threshold energy of ~6 MeV can be expected, and a maximum cross section of ~440 millibarns at ~11.5 MeV. The maximum incident energy of the incident gamma ray for this reaction is about 12 MeV in order to minimize the production of unwanted $^{228}$Th by the $^{230}$Th[γ,2n]$^{229}$Th reaction. Production of $^{231}$Th via the $^{232}$Th[γ,n] reaction is known to be 22 mCi/h/g of $^{232}$Th in a 10 kW electron accelerator producing 25 MeV electrons. If $^{229}$Th is produced from $^{230}$Th at the same rate, the product activity of $^{229}$Th will be 0.21 μCi/d/g of $^{230}$Th.

In another embodiment, thorium-229 is produced via proton and deuteron irradiation of thorium-230 targets, such as in an accelerator. Both reactions are believed to actually proceed through production of relatively short-lived protactinum-229 having a half life of only 1.5 day, $^{230}$Th[p,2n]$^{229}$Pa(EC, $t_{1/2}$=1.5 d)$^{229}$Th and $^{230}$Th[d,3n]$^{229}$Pa(EC, $t_{1/2}$=1.5 d)$^{229}$Th reactions, respectively. No excitation functions for these reactions are reported. In the case of the proton-induced reaction, from the reported excitation function for a similar reaction using a thorium-232 target, $^{232}$Th[p,2n] reaction, a threshold energy of ~10 MeV can be expected, a maximum cross section of ~400 millibarns at ~15 MeV, and a cross section of ~200 mb at 20 MeV. However, in order to minimize the production of unwanted $^{228}$Th by the $^{230}$Th[p,3n]$^{228}$Pa(EC, $t_{1/2}$=22 h)$^{228}$Th reaction, the maximum energy of the incident proton used for this reaction is limited to about 16 MeV. Assuming an average cross section of 200 mb, bombarding a foil of $^{230}$Th with a thickness of 0.5 mm (~0.55 g/cm$^2$, range of protons 16 →10 MeV) translates to a production rate of ~0.6 μCi of $^{229}$Th per day at a 100 μA current of protons with an incident energy of 16 MeV.

In the case of the deuteron-induced reaction, from the reported excitation functions of for a similar reaction using a bismuth-209 target, $^{209}$Bi[d,3n] reaction, a deuteron threshold energy of ~16 MeV can be extrapolated. Above the threshold, the cross section sharply increases to a maximum of ~1.5 barn, then drops off rapidly to ~500 mb at 32 MeV. The maximum energy of the incident deuteron for this reaction is about 28 MeV, in order to reduce the probability of the evaporation of an additional neutron which results in the production of unwanted $^{228}$Th by the $^{230}$Th[d,4n]$^{228}$ Pa(EC, $t_{1/2}$=22 h)$^{228}$Th reaction. In this case, assuming an average cross section of 700 mb, bombarding a foil of $^{230}$Th with a thickness of 0.7 mm (~0.78 g/cm$^2$, range of deuterons 28→16 MeV) results in a production rate of ~3 μCi of $^{229}$Th per day at a 50 μA current of deuterons with an incident energy of 28 MeV.

The necessary fast turn-around for processing of the Ra target in the direct production of $^{225}$Ra and $^{225}$Ac (a few days post-irradiation) is the main disadvantage for proton, deuteron and gamma ray irradiation of a radium target via $^{226}$Ra [p,2n]$^{225}$Ac, $^{226}$Ra[p,pn]$^{225}$Ra($t_{1/2}$=15 days,β$^-$) $^{225}$Ac, or $^{226}$Ra[γ,n]$^{225}$Ra($t_{1/2}$=15 days,β$^-$)$^{225}$Ac reactions. The main drawback in the reactor approach for the production of $^{229}$Th using a $^{226}$Ra target is the significant contamination of $^{229}$Th with $^{228}$Th($t_{1/2}$=2.8 y) that generally results. The approaches for production of $^{229}$Th via alpha or $^3$He bombardment of a radium-226 target described above generally provides thorium-229 with significantly reduced levels of $^{228}$Th contamination. The fast neutron irradiation of a thorium-230 target, or neutron capture by $^{228}$Ra generally also provides thorium-229 with significantly reduced levels of $^{228}$Th contamination as compared to the reactor approach using a $^{226}$Ra target.

The thorium-229 generated using the invention must be separated from the target material and other by-products generated for most uses. Radiochemical procedures can be used for the separation of thorium-229 from target materials and by-products. The chemical processing of U, Th, Ac and Ra has been studied extensively in the past 70 years and is well known. In summary, after irradiation, the target can be dissolved and Th selectively retained on anion exchange resin (e.g. MP1 resin, BioRad Inc.) from 7.5 M $HNO_3$ as the $Th(NO_3)_6^{2-}$ complex, while U(VI), Ac(III), Fe(III), Al(III), Ra(II) and Pb(II) and a number of fission products are eluted. Subsequent to the elution of Th from the column with O.1 M $HNO_3$, the Th is further purified by hydroxide precipitation in the presence of the $Fe^{+3}$ carrier to eliminate Tc and I. Thorium is then separated from the $Fe^{+3}$ carrier by retaining $FeCl_4^-$ on an anion exchange column in 10 M HCl. After allowing $^{225}$Ra and $^{225}$Ac to reach their equilibrium values (~45 days), they are separated from Th using anion exchange resin and 7.5 M $HNO_3$ as described above. Separation of Ac from Ra is accomplished by one of two methods, both based on cation exchange resin from nitric acid media. In the first method, using 1.2 M $HNO_3$ as eluent, $Ra^{+2}$ is eluted ahead of $Ac^{+3}$ with a small overlap. When the eluent is changed to 0.15 M $NH_4Cl$ and 0.1 M NaEDTA, pH~5, (the second method), Ac is eluted quantitatively whereas Ra remains adsorbed on the resin (reverse phase chromatography). Both methods have been tested extensively for the separation of carrier-free $^{225}Ac$ from $^{224}Ra$ and $^{225}Ra$ and they work well.

Thorium-229 produced using the invention is expected to be used for a variety of medical applications, such as for killing cancer cells. With appropriate biological targeting molecules, bismuth-213 can be used not only in cancer therapy but also for autoimmune diseases, organ transplantations, bone marrow ablations, and vasculature irradiation following restenosis.

For example, the invention can be used for cell-directed radiation therapy. In this method, millions of cancer seeking antibodies guide radiation to the cancer. Energetic radioactive isotopes (radioisotopes which are capable of depositing a significant amount of energy in a short distance in the tissue) according to the invention are attached to the antibodies. As the cancer hunting antibodies flow though the blood stream, the radioactive isotopes ride along. The antibodies target cell surface binding sites specific to the cancer cells. When the antibodies reach a cancer cell, they attach. Radiation from these bound radioisotopes then destroys the cancer cells that make up the malignant tumor.

This invention can be embodied in other forms without departing from the spirit or essential attributes thereof and, accordingly, reference should be had to the following claims rather than the foregoing specification as indicating the scope of the invention.

We claim:

1. A method for producing ground state $^{229}Th$, comprising the steps of:

providing a target material comprising $^{226}Ra$, bombarding said target material with helium nuclei from a helium nuclei source to form ground state $^{229}Th$, and controlling said helium nuclei source to produce said helium nuclei with an incident energy between 8 and 20 MeV.

2. The method of claim 1, wherein said helium nuclei comprise alpha particles.

3. The method of claim 1, wherein said helium nuclei comprise alpha particles and said helium nuclei source is controlled to produce alpha particles having an incident energy between 15 MeV and 20 MeV.

4. The method of claim 1, wherein said helium nuclei comprise alpha particles and said helium nuclei source is controlled to produce alpha particles having an incident energy selected to preferentially trigger a $^{226}Ra[\alpha,n]^{229}Th$ reaction producing ground state $^{229}Th$, while minimizing production of ground state $^{228}Th$.

5. The method of claim 1, wherein said helium nuclei comprise helium-3 particles.

6. The method of claim 1, wherein said helium nuclei comprise helium-3 particles and said helium nuclei source is controlled to produce helium-3 particles having an incident energy selected to preferentially trigger a $^{226}Ra[^{3}He,\gamma]^{229}Th$ reaction producing ground state $^{229}Th$, while minimizing production of ground state $^{228}Th$.

7. A method for producing ground state $^{229}Th$, comprising the steps of:

providing a target material comprising $^{226}Ra$, bombarding said target material with helium nuclei from a cyclotron nuclei source to form ground state $^{229}Th$, and controlling said cyclotron to produce said helium nuclei with an incident energy between 8 and 20 MeV.

8. The method of claim 7, wherein said helium nuclei comprise alpha particles.

9. The method of claim 7, wherein said helium nuclei comprise alpha particles and said cyclotron is controlled to produce alpha particles having an incident energy between 15 MeV and 20 MeV.

10. The method of claim 7, wherein said helium nuclei comprise alpha particles and said cyclotron is controlled to produce alpha particles having an incident energy selected to preferentially trigger a $^{226}Ra[\alpha,n]^{229}Th$ reaction producing ground state $^{229}Th$, while minimizing production of ground state $^{228}Th$.

11. The method of claim 7, wherein said helium nuclei comprise helium-3 particles.

12. The method of claim 7, wherein said helium nuclei comprise helium-3 particles and said cyclotron is controlled to produce helium-3 particles having an incident energy selected to preferentially trigger a $^{226}Ra[^{3}He,\gamma]^{229}Th$ reaction producing ground state $^{229}Th$, while minimizing production of ground state $^{228}Th$.

13. A method for producing ground state $^{229}Th$, comprising the steps of:

providing a target material comprising $^{226}Ra$, bombarding said target material with alpha particles from an alpha particle source to form ground state $^{229}Th$, and controlling said alpha particle source to produce said alpha particles with an incident energy between 15 and 20 MeV.

14. The method of claim 1, wherein said alpha particle source is controlled to produce alpha particles having an incident energy selected to preferentially trigger a $^{226}Ra[\alpha,n]^{229}Th$ reaction producing ground state $^{229}Th$, while minimizing production of ground state $^{228}Th$.

* * * * *